US007536986B2

(12) United States Patent
Schneider

(10) Patent No.: US 7,536,986 B2
(45) Date of Patent: May 26, 2009

(54) CAMSHAFT

(75) Inventor: Falk Schneider, Korntal-Münchingen (DE)

(73) Assignee: MAHLE International GmbH, Stuttgart (DE)

( * ) Notice: Subject to any disclaimer, the term of this patent is extended or adjusted under 35 U.S.C. 154(b) by 162 days.

(21) Appl. No.: 11/801,725

(22) Filed: May 10, 2007

(65) Prior Publication Data

US 2007/0272183 A1 Nov. 29, 2007

(30) Foreign Application Priority Data

May 27, 2006 (DE) ..... 10 2006 024 793

(51) Int. Cl.
*F01L 1/34* (2006.01)

(52) U.S. Cl. ..... 123/90.17; 123/90.6; 123/90.15; 123/90.31

(58) Field of Classification Search ..... 123/90.15, 123/90.17, 90.6, 90.31
See application file for complete search history.

(56) References Cited

U.S. PATENT DOCUMENTS 5,417,186 A * 5/1995 Elrod et al. ..... 123/90.17
6,971,353 B2 12/2005 Heinze et al.

FOREIGN PATENT DOCUMENTS

| | | | |
|---|---|---|---|
| DE | 44 15 524 | A1 | 11/1994 |
| DE | 103 30 449 | B3 | 2/2005 |
| DE | 10 2004 035 035 | A1 | 3/2005 |
| DE | 103 46 448 | A1 | 6/2005 |
| EP | 1 429 035 | A2 | 6/2004 |

* cited by examiner

*Primary Examiner*—Zelalem Eshete
(74) *Attorney, Agent, or Firm*—Collard & Roe, P.C.

(57) ABSTRACT

The present invention relates to a camshaft (1) having an inner shaft (3) arranged coaxially in an outer shaft (2) and mounted to rotate with respect to the outer shaft (2). The camshaft (1) has a first phase adjuster (7) and a second phase adjuster (8), the first phase adjuster (7) adjusting a phase relation of the inner shaft (3) and thus of the first cams in relation to a drive, in particular a crankshaft, while the second phase adjuster (8) adjusts a phase relation of the outer shaft (2) in relation to the drive. Thus the first and second phase adjusters (7, 8) each have a switchable hydraulic valve (9, 10), both being arranged inside the inner shaft (3).

9 Claims, 2 Drawing Sheets

CAMSHAFT

CROSS REFERENCE TO RELATED APPLICATIONS

Figure 1:
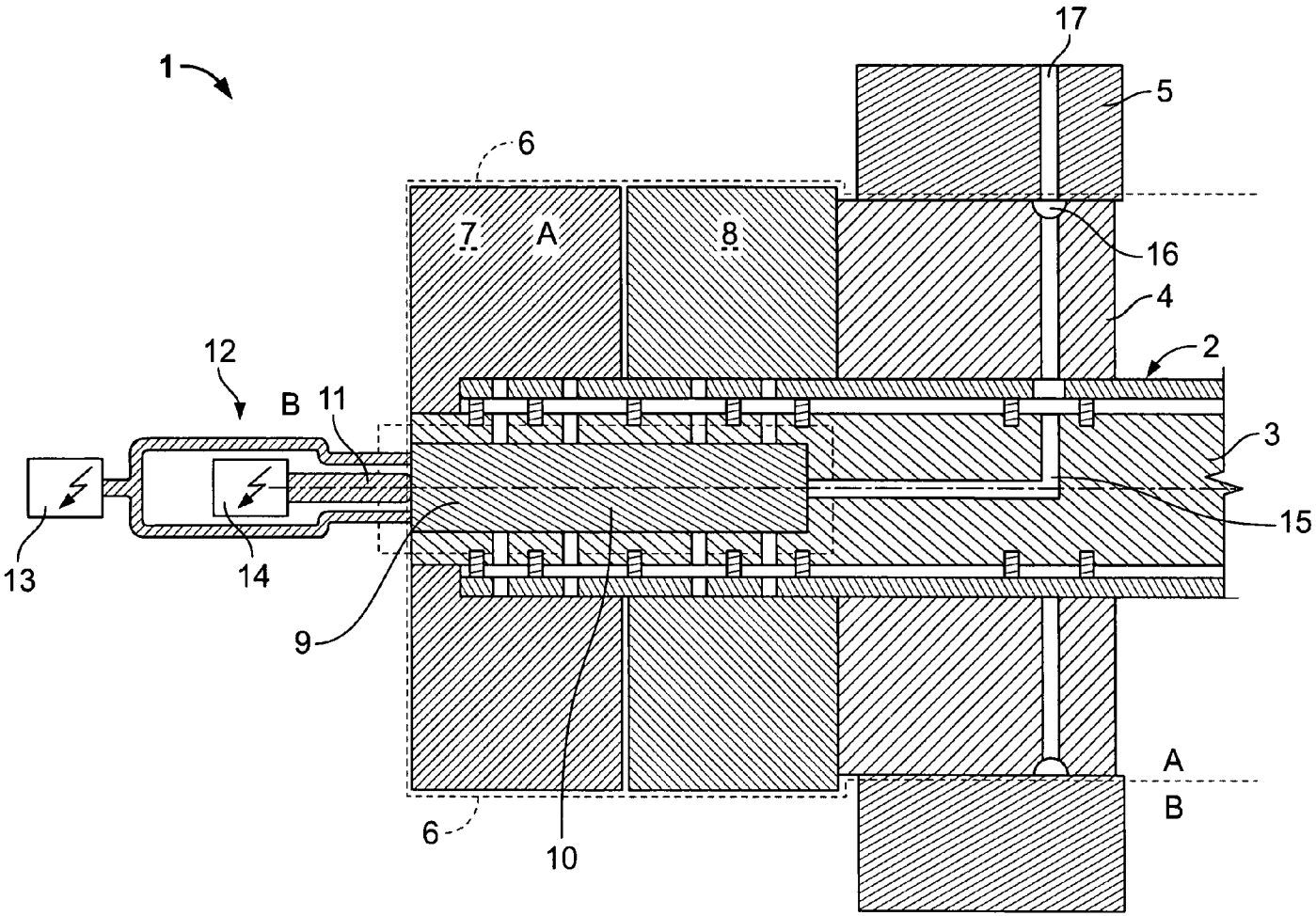

Applicant claims priority under 35 U.S.C. §119 of German Application No. 10 2006 024 793.0 filed May 27, 2006.

The invention relates to a camshaft of automotive engines in particular, having an inner shaft arranged coaxially in an outer shaft and mounted so it can rotate with respect to the outside shaft.

To reduce fuel consumption and emissions and to increase power and torque, many gasoline engines today are equipped with camshaft adjusters as a rule. These camshaft adjusters, also known as phase adjusters, alter the phase relation of the camshaft in relation to the crankshaft.

DE 103 46 448 A1 describes a camshaft adjuster for an internal combustion engine, having a control valve that is inserted into a camshaft and has a hydraulic control piston guided in a guide sleeve. With this hydraulic control piston, an actuator unit can be controlled for adjusting the angle of the camshaft. The actuator unit has an internal body fixedly connected to the camshaft and an external body mounted so it can rotate in relation to the camshaft and by means of which a drive connection runs from the crankshaft to the camshaft and whereby the control valve is acted upon by a electromagnetic device and is supplied with hydraulic medium via the camshaft. In addition, an oil guidance module is inserted into the camshaft, serving at least to guide the hydraulic medium between the interior of the camshaft and the control valve. The camshaft disclosed there is designed as a one-piece camshaft.

DE 44 15 524 A1 describes a hydraulic actuator device for altering and adjusting the valve control times of a camshaft driven by a crankshaft of an internal combustion engine. The rotational position of the camshaft is adjustable by a limited angle of rotation, whereby blades that sit in a chamber are acted upon by hydraulic means.

DE 10 2004 035 035 A1 and DE 103 30 449 B3 disclose other camshaft adjusters for internal combustion engines.

The present invention relates to the problem of arranging a camshaft adjuster for a camshaft having an inner shaft and an outside shaft so as to minimize installation space as much as possible.

This problem is solved according to this invention through the subject of the independent Claim 1. Advantageous embodiments are the subject of the dependent claims.

The present invention is based on the general idea of arranging at least a portion of the phase adjustment, in particular its shiftable hydraulic valves, essentially inside an inner shaft of the camshaft which consists of an inner shaft and an outside shaft. The inner shaft is coaxially mounted in the outer shaft so that it can rotate with respect to the latter, but in addition, contrarotating first and second cams are also provided, the first cam being fixedly connected to the inner shaft and the second cam being fixedly connected to the outer shaft. For adjusting the inner shaft and/or the first cam connected thereto and adjusting the outer shaft and/or the second cam connected thereto, the inventive camshaft has the above-mentioned phase adjusters, namely a first and a second phase adjuster, whereby the first phase adjuster adjusts a phase relation of the inner shaft and the second phase adjuster adjusts a phase relation of the outer shaft, each in relation to the drive, e.g., of a crankshaft. The arrangement of a switchable hydraulic valve belonging to the respective phase adjuster inside the inner shaft allows a design that optimizes design space and is especially space-saving. The fact that the oil supply required for controlling the hydraulic valves is also arranged inside the inner shaft is of particular importance and/or advantage here. An oil feed that is provided at any rate for lubrication of the bearings of the camshaft is preferably used here, so that no additional hydraulic lines need be provided in the cylinder head. Consequently, the inventive camshaft may also be installed on traditional cylinder heads.

In an advantageous embodiment of the inventive approach, an actuating device is provided for actuating and/or controlling the two hydraulic valves, comprising a first and a second electromagnetic, the first electromagnetic actuating the first hydraulic valve and the second electromagnetic actuating the second hydraulic valve. The electromagnets which are part of the actuating device are preferably arranged in a stationary position in or on the cylinder head and are stationary in contrast with the rotating hydraulic valves. Electromagnets today can be manufactured inexpensively in virtually any design and also operate with a high precision, thus enabling the creation of reliable, accurate and also inexpensive means of controlling the hydraulic valves.

In another advantageous embodiment of the inventive approach, the second electromagnet has a valve lifter for actuation of the second hydraulic valve which passes centrally through the first hydraulic valve. This valve lifter, which is arranged essentially coaxially with the first hydraulic valve, allows the control of both hydraulic valves from a common side, so that a tandem arrangement of the two hydraulic valves inside the inner shaft becomes possible for the first time. The axial channel inside the first hydraulic valve which is required for the passage of the valve lifter can be provided easily, because this area of the first hydraulic valve is not needed at all for actuation of the phase adjuster.

In another advantageous embodiment of the inventive approach, the two hydraulic valves inside the inner shaft are supplied with hydraulic medium over a shared hydraulic line which communicates with a hydraulic channel running in the bearing via a ring channel facing a bearing of the camshaft. The hydraulic channel present in the bearing anyway serves to provide bearing lubrication and may additionally be used for supplying the two hydraulic valves. Since the hydraulic channel for lubrication of the camshaft bearing is present anyway in many traditional engines, the inventive camshaft can also be incorporated into traditional engines with no problem. At the same time, the one channel allows a reduction in the hydraulic lines to be arranged, so that the complexity of the components can be reduced significantly, in particular the complexity of the inner shaft and the bearing.

Other important features and advantages of the invention are derived from the subclaims, the drawings and the respective description of the figures on the basis of the drawings.

It is self-evident that the features mentioned above and those yet to be explained below may be used not only in the particular combination given but also in other combinations or alone without going beyond the scope of the present invention.

Preferred exemplary embodiments of the invention are depicted in the drawings and explained in greater detail in the following description.

They show, each in schematic diagrams

Figure 2:
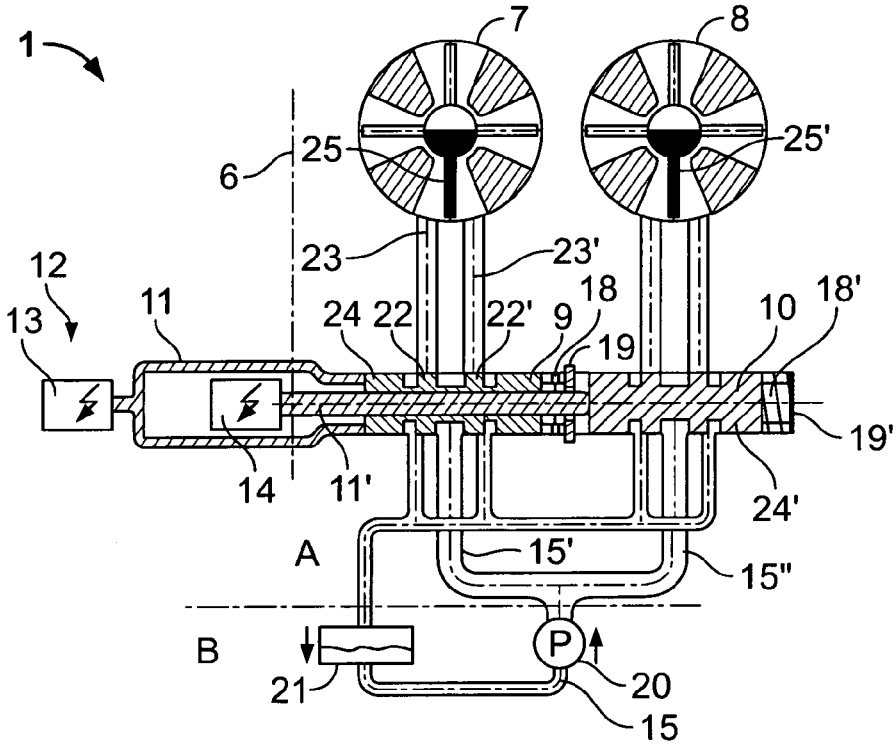
Figure 3:
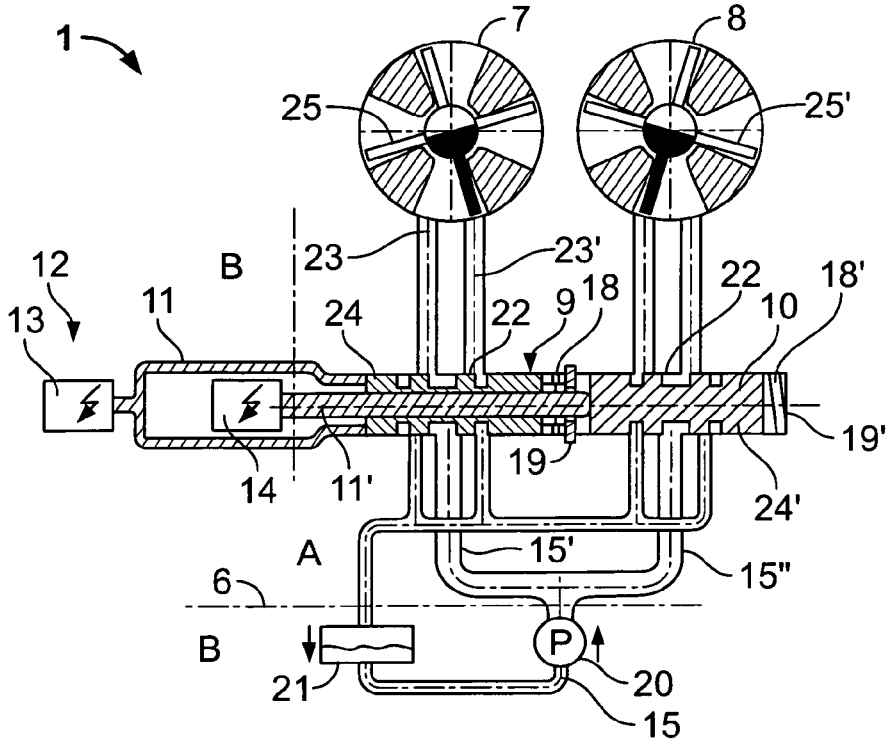

FIG. 1 a longitudinal section through an inventive camshaft in the area of its phase adjuster, FIG. 2 a longitudinal section through the inner shaft of the camshaft with the phase adjusters shown schematically, FIG. 3 a diagram like that in FIG. 2, but in a different position of the hydraulic valves.

According to FIG. 1, a camshaft 1, in particular a camshaft 1 of an automotive engine, has an inner shaft 3 arranged coaxially in an outer shaft 2, the inner shaft being mounted so it can rotate with respect to the outer shaft 2. The camshaft 1 is supported via a bearing element 4 that is on the camshaft end and is in turn mounted on a bearing element 5 at the cylinder head end. The bold dash-dot line 6 shown in FIG. 1 represents the dividing line between an area A and an area B, where the area A has rotating components while the area B has stationary components.

The camshaft 1 shown in FIG. 1 is designed as a so-called adjustable camshaft and therefore has first and second cams that can rotate with respect to one another, the first cam being fixedly connected to the inner shaft 3 and the second cam being fixedly connected to the outer shaft 2. The first and second cams are not shown in FIGS. 1 through 3. At the longitudinal end, i.e., in the area of the longitudinal end of the camshaft 1, a first phase adjuster 7 and a second phase adjuster 8 are arranged thereon, whereby the first phase adjuster 7 adjusts a phase relation of the inner shaft 3 and thus of the first cam in relation to a drive, e.g., a crankshaft (not shown), while the second phase adjuster 8 adjusts a phase relation of the outer shaft 2 and thus the second cam in relation to the crankshaft. The phase adjusters 7 and 8 thus alter the phase relation of the camshaft 1 and/or of the inner shaft 3 and the outer shaft 2 in relation to the crankshaft and therefore allow a reduction in fuel consumption and/or emissions and an increase in power and torque.

FIG. 1 also shows that the first phase adjuster 7, and the second phase adjuster 8 each have a switchable hydraulic valve 9 and 10 (shown with continuous lines in FIG. 1), both being arranged inside the inner shaft 3. This allows a space-saving arrangement, which thus minimizes installation space, of the hydraulic valves 9, 10 belonging to the phase adjusters 7, 8 and at the same time accommodation thereof inside the inner shaft 3 in such a way as to prevent wear.

As FIGS. 1 through 3 show, the two hydraulic valves 9, 10 are arranged adjacent to one another in the axial direction of the shafts 2 and 3 inside the inner shaft 3. This so-called tandem arrangement requires that for control of the two hydraulic valves 9 and 10, the first hydraulic valve is penetrated by a control element, in particular a valve lifter 11', to control the second hydraulic valve 10 in particular. In general, an actuating device 12 having a first electromagnet 13 and a second electromagnet 14 is provided for controlling the two hydraulic valves 9 and 10, the first electromagnet 13 actuating the first hydraulic valve 9 and the second electromagnet 14 actuating the second hydraulic valve 10 accordingly. Both the first electromagnet 13 and the second electromagnet 14 are arranged in the area B, i.e., in a stationary area. This means that the actuating device 12 on the whole is arranged in a stationary mount on a cylinder head (not shown) while the hydraulic valves 9 and 10 are connected to the inner shaft 3 in a rotationally fixed manner.

The two hydraulic valves 9 and 10 are supplied with hydraulic medium, e.g., oil, through a shared hydraulic line 15 which communicates with a hydraulic channel 17 running in the bearing element 5 in the cylinder head via a ring channel 16 that faces the bearing element 5 near the cylinder head. The ring channel 16 allows the camshaft to rotate without interrupting a shared hydraulic line 15 for the oil supply. The hydraulic channel 17 in the bearing element 5 at the cylinder head end at the same time represents an oil supply for lubrication of a ring gap between the two bearing elements 4 and 5 and is present in traditional engines anyway. Thus, all that is necessary is a hydraulic line to supply the two hydraulic valves 9 and 10, thereby making it possible to significantly reduce the complexity of the components, in particular the bearing element 4 and the bearing element 5 on the cylinder head end.

As shown in FIGS. 2 and 3, the shared hydraulic line 15 inside the inner shaft 3 is divided before reaching the two hydraulic valves 9 and 10 into a first hydraulic line 15' which supplies the first hydraulic valve 9 and a second hydraulic line 15" which supplies the second hydraulic valve 10. As FIGS. 2 and 3 also indicate, the two hydraulic valves 9 and 10 are designed as spring-loaded slide valves, prestressed by the electromagnets 13 and 14 against a spring 18, 18' via corresponding valve lifters 11, 11', these springs being supported at the other end on a respective stop 19, 19' on the inner shaft 3. The valve lifter 11' passes through the first hydraulic valve 9 required for actuation of the second hydraulic valve 10 according to FIGS. 2 and 3.

The functioning of the two hydraulic valves 9 and 10 in conjunction with the two respective phase adjusters 7 and 8 is explained briefly below.

In FIG. 2, a pump 20 conveys hydraulic medium continuously from a reservoir 21 through the corresponding lines 15' and 15" to the first hydraulic valve 9 and/or to the second hydraulic valve 10. The first hydraulic valve 9 is set so that channels 23, 23' leading to the first phase adjuster 7 are closed by corresponding protrusions 22, 22' on the slide valve 24 of the first hydraulic valve 9. Thus an impeller phase adjuster 25 remains in a central position. The second hydraulic valve 9 is also in the same position so that the second phase adjuster 8 also remains in a central position.

In FIG. 3 an adjustment of the slide valve 24 of the first hydraulic valve 9 and an adjustment of the slide 24' of the second hydraulic valve 10 are accomplished by the actuating device 12 and/or the first electromagnet 13 and the second magnet electromagnet 14. The first electromagnet 13 moves the valve lifter 11 to the right according to FIG. 3, thereby also displacing the slide 24' to the right against the spring force exerted by the spring 18'. In the opposite direction the slide 24 of the first hydraulic valve 9 is shifted to the left, so that the channel 23 which leads to the first phase adjuster 7 is opened. This induces a counterclockwise rotational movement of the impeller and thus an adjustment of the inner shaft 3 and/or the first cam connected thereto. By analogy, the clockwise adjustment of the impeller wheel 25' also functions in the same way in the second phase adjuster 8.

The invention claimed is:

1. A camshaft (1) of automotive engines in particular,having an inner shaft (3) arranged coaxially in an outer shaft (2), mounted to rotate with respect to the outer shaft (2), having first and second cams rotatable with respect to one another, the first cams being fixedly connected to the inner shaft (3) and the second cams being fixedly connected to the outer shaft (2), with a first and a second phase adjuster (7, 8), the first phase adjuster (7) adjusting a phase relation of the inner shaft (3) and thus the first cams in relation to a drive, while the second phase adjuster (8) adjusts a phase relation of the outer shaft (2) and thus the second cams in relation to the drive, whereby the first and second phase adjusters (7, 8) each have a shiftable hydraulic valve (9, 10), both being arranged essentially inside the inner shaft (3).

2. The camshaft according to claim 1, wherein the two hydraulic valves (9, 10) are arranged adjacent to one another in the inner shaft (3) in the axial direction.

3. The camshaft according to claim 1, wherein an actuating device (12) is provided for controlling the two hydraulic valves (9, 10), having a first and a second electromagnet (13, 14), the first electromagnet (13) actuating the first hydraulic valve (9) and the second electromagnet (14) actuating the second hydraulic valve (10).

4. The camshaft according to claim 3, wherein the actuating device (12) is arranged in a stationary mount on the cylinder head, while the hydraulic valves (9, 10) are connected to the inner shaft (3) in a rotationally fixed manner.

5. The camshaft according to claim 2, wherein the two hydraulic valves (9, 10) are supplied with hydraulic medium through a shared hydraulic line (15) which communicates with a hydraulic channel (17) running in the bearing (5) via a ring channel (16) facing a bearing (5) of the camshaft (1).

6. The camshaft according to claim 5, wherein the shared hydraulic line (15) splits inside the inner shaft (3) into a hydraulic line (15') that supplies the first hydraulic valve and (9) a hydraulic line (15") that supplies the second hydraulic valve (10).

7. The camshaft according to claim 1, wherein the two hydraulic valves (9, 10) are arranged in an axial end area of the camshaft (1).

8. The camshaft according to claim 2, wherein the two hydraulic valves (9, 10) are designed as spring-loaded slide valves.

9. The camshaft according to claim 3, wherein the second electromagnet (14) has a valve lifter (11') for actuation of the second hydraulic valve (10), said valve lifter running centrally through the first hydraulic valve (9).

* * * * *